United States Patent [19]

Brackmann

[11] Patent Number: 5,071,179

[45] Date of Patent: Dec. 10, 1991

[54] MOTOR-VEHICLE DOOR LATCH AND METHOD OF INSTALLING SAME

[75] Inventor: Horst Brackmann, Velbert, Fed. Rep. of Germany

[73] Assignee: Kiekert GmbH & Co. Kommanditgesellschaft, Heiligenhaus, Fed. Rep. of Germany

[21] Appl. No.: 505,671

[22] Filed: Apr. 5, 1990

[30] Foreign Application Priority Data

Apr. 7, 1989 [DE] Fed. Rep. of Germany ..... 3911327

[51] Int. Cl.[5] ..... E05C 3/26

[52] U.S. Cl. ..... 292/216; 292/DIG. 60; 292/DIG. 23

[58] Field of Search ..... 292/DIG. 53, DIG. 64, 292/DIG. 60, 216, DIG. 23

[56] References Cited

U.S. PATENT DOCUMENTS

| | | | |
|---|---|---|---|
| 2,793,898 | 5/1957 | Roethel | 292/DIG. 60 |
| 2,832,626 | 4/1958 | Priestman | 292/DIG. 60 |
| 2,961,265 | 11/1960 | Jakeman et al. | 292/DIG. 23 |
| 3,233,931 | 2/1966 | Peras | 292/DIG. 23 |
| 4,073,170 | 2/1978 | Miyabayashi et al. | 292/DIG. 37 |
| 4,202,571 | 5/1980 | Nishikoori | 292/DIG. 23 |
| 4,762,349 | 8/1988 | Ikeda | 292/DIG. 53 |

*Primary Examiner*—Eric K. Nicholson

*Attorney, Agent, or Firm*—Herbert Dubno; Andrew M. Wilford

[57] ABSTRACT

A motor-vehicle door latch for mounting in a door having an outside panel has a housing fixed in the door, a latching fork pivotal in the housing, and a latching pawl pivotal in the housing and engageable with the fork. An outside door handle is displaceable on the outside door panel between an outer actuating position and an inner rest position. A linkage includes an outside-handle lever coupled to the outside door handle and movable thereby, a latch lever pivoted on the outside-handle lever and engageable with the pawl to operate same and release the fork, and a releasable coupler including a bolt for coupling the outside-handle and latch levers together for joint pivoting and for decoupling them for relative pivoting. Thus when these levers are decoupled the outside-handle lever can move between an operating position and an installation position.

6 Claims, 5 Drawing Sheets

MOTOR-VEHICLE DOOR LATCH AND METHOD OF INSTALLING SAME

FIELD OF THE INVENTION

The present invention relates to a motor-vehicle door latch. More particularly this invention concerns such a latch and a method of installing it in a motor-vehicle door.

BACKGROUND OF THE INVENTION

A standard motor-vehicle door latch has a latch housing mounted on a door edge, a latch fork pivotal on the housing and latchingly engageable around a doorpost-mounted lock bolt, and a lock pawl mounted on the housing for retaining the fork latched around the bolt or releasing it to free the bolt. This pawl can be moved into the fork-freeing position by inside and outside door handles, and the outside handle at least can be decoupled from the pawl by locking mechanisms inside and outside the door.

Typically the outside handle is pulled out to open the door, as such movement makes pulling the door open a natural extension of the unlatching operation. To this end a lever linkage is provided that couples the outside door handle to the lock pawl.

Even in a good mass-production operation the thickness of the vehicle door, that is the horizontal distance between the inside and outside door panels, can vary considerably. In order to compensate for these variations in thickness tolerance, it is therefore standard to make the outside door handle travel through a considerable stroke through part of which it is effective to act on the lock pawl through the above-mentioned lever linkage. Not only does this make for sloppy lock action, but the force that resists movement of the outside door handle varies considerably over its stroke, being considerably more during the short portion of this stroke that the unlatching work is actually done.

It has been suggested to provide complicated adjustment capabilities in the door latch in order to avoid this problem. All such provisions, however, make for considerable installation work for the door latch. Skilled personnel must carry out specialized adjustment operations on each latch, thereby increasing production costs. Furthermore any misadjustment is frequently discovered only after the door is fully assembled, so that it must be taken apart for readjustment.

OBJECTS OF THE INVENTION

It is therefore an object of the present invention to provide a improved motor-vehicle door latch.

Another object is the provision of such an improved motor-vehicle door latch which overcomes the above-given disadvantages, that is which can easily be adjusted to compensate for doors of different thickness so that there is no free travel of the outside door handle, that is it moves through a short stroke to unlatch the door.

A further object is to provide an improved method of mounting such a latch in a motor-vehicle door.

SUMMARY OF THE INVENTION

A motor-vehicle door latch for mounting in a door having an outside panel according to the invention has a housing fixed in the door, a latching fork pivotal in the housing, and a latching pawl pivotal in the housing and engageable with the fork. An outside door handle is displaceable on the outside door panel between an outer actuating position and an inner rest position. A linkage on the housing inside the door includes an outside-handle lever coupled to the outside door handle and movable thereby, a latch lever pivoted on the outside-handle lever and engageable with the pawl to operate same and release the fork, and a releasable coupler including a bolt for coupling the outside-handle and latch levers together for joint pivoting and for decoupling them for relative pivoting. Thus when these levers are decoupled the outside-handle lever can move between an operating position and an installation position.

Thus according to this invention the latch is first mounted on the door. Then, as the outside door handle is mounted on the door, it pushes the outside-handle lever from the installation position into the operating position. Subsequently the outside door lever is coupled to the latch lever for joint rotation. Springs are provided to bias the parts together such that only a simple nut and bolt connection need be tightened once to set the position.

According to another feature of this invention the outside door handle is formed with a pusher shoulder engageable on installation with the outside-handle lever to move same from the installation to the operating position. In addition the outside door handle and outside-handle lever have complementary interengageable formations that lock them when engaged together for joint movement.

DESCRIPTION OF THE DRAWING

The above and other objects, features, and advantages will become more readily apparent from the following, reference being made to the accompanying drawing in which.

SPECIFIC DESCRIPTION

Figure 1:
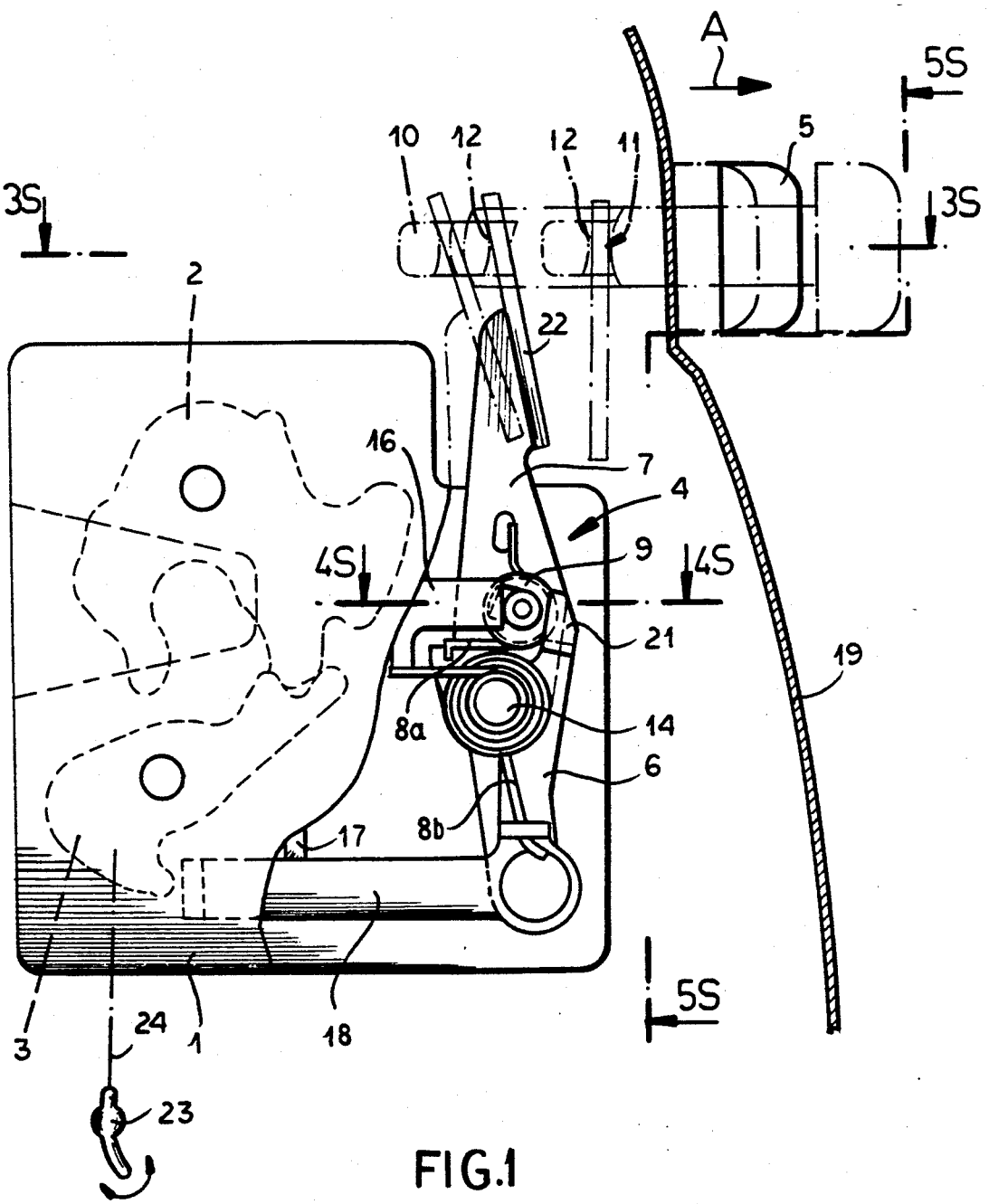
FIG. 1 is a vertical section through a door latch and door according to this invention.

As seen in FIG. 1 a motor-vehicle door latch basically comprises a latch housing 1 fixed in a motor-vehicle door having an outer panel 19 and an edge panel 20 (FIG. 4) and itself carrying a standard pivotal lock fork 2 that can be retained and released by a pivotal lock pawl 3. A bolt normally projecting in the vehicle-travel direction (arrow B in FIG. 3) can be caught and held by the fork 2. The pawl 3 can be operated to release the fork 2 by means of an inside door handle 23 through mechanism which is illustrated schematically at 24 and which is known per se, and from outside the door by a lever linkage 4 coupled to an outside door handle 5 of the type that is pulled transverse to the travel direction B in an actuating direction A to unlatch the door.

According to this invention the lever linkage 4 is basically formed by a latch lever 6 (see FIGS. **6*a* and 6*b*) coupled via a pusher arm 18 to the pawl 3 and an outside-door lever 7 coupled to the handle 5. The two levers 6 and 7 are pivoted together on the housing at a bolt 14 extending in the direction B. Springs 8*a* and 8*b*** are integral with the levers 6 and 7. The spring 8*b* continuously urges the lower lever 6 counterclockwise as seen in FIG. 1 and the pusher arm 18 clockwise against a stop 17 that can be moved by inside locking mechanism to decouple the outside handle 5 from the pawl 3.

Figure 2A:
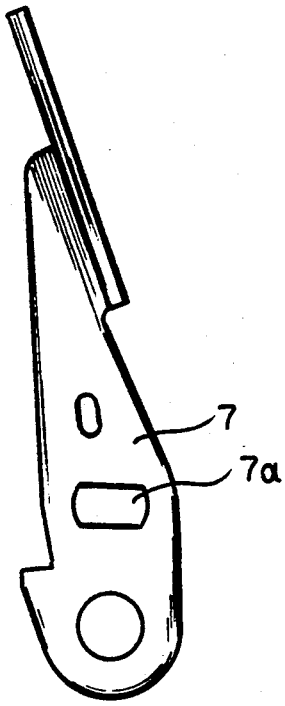
FIG. 2A is a side view of the outside-handle lever of this invention.
Figure 2B:
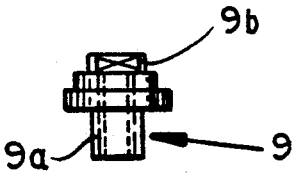
FIGS. 2B and 2C are side and end views of the coupling nut in accordance with the invention.
Figure 2C:
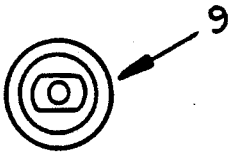
Figure 4:
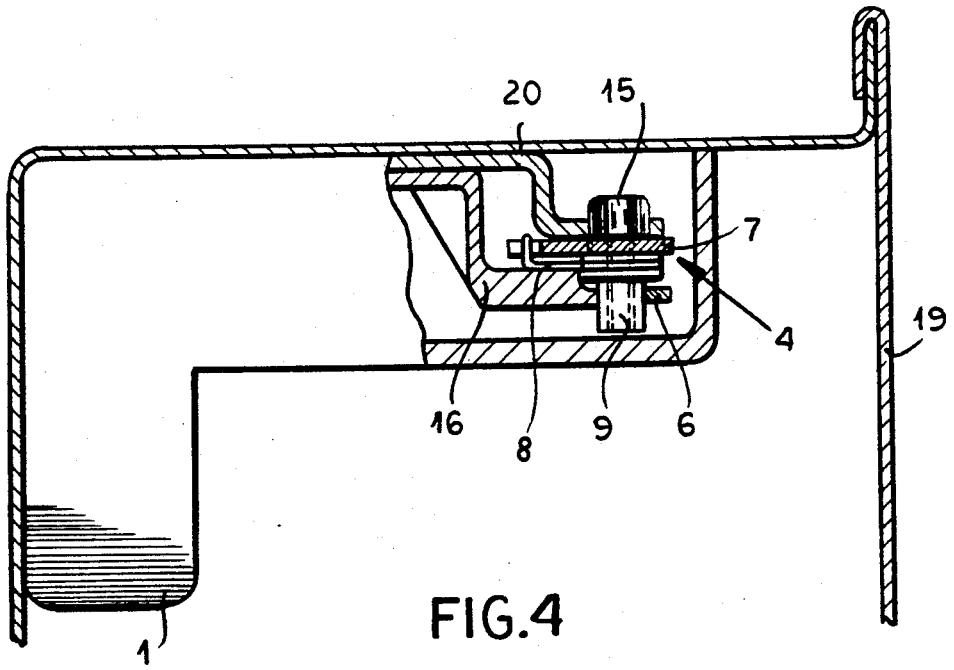
Figure 5:
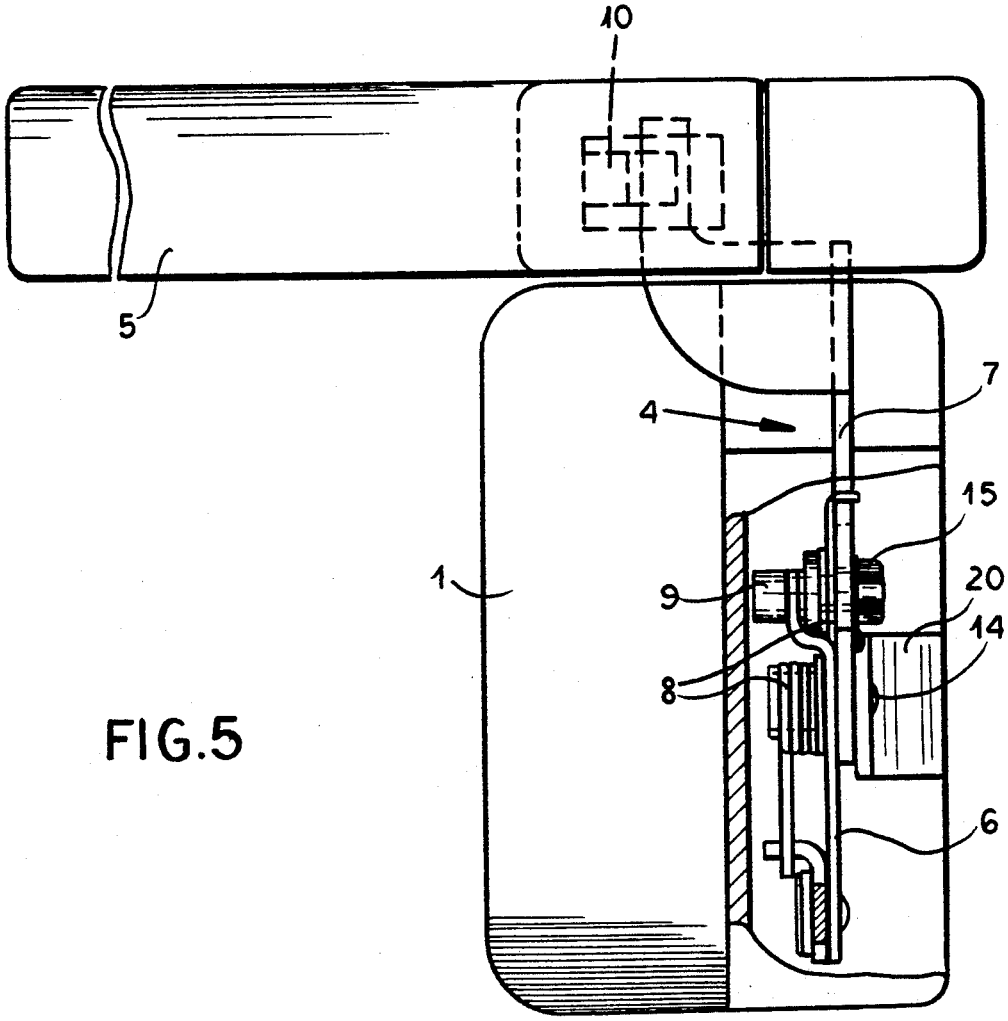
Figure 6A:
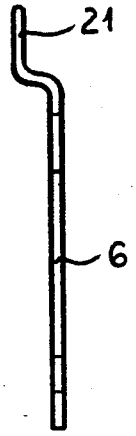
FIGS. 6A and 6B are side and front views of a detail of the invention.
Figure 6B:
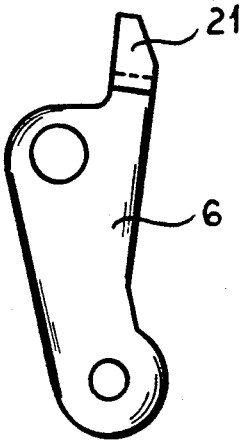

The two levers 6 and 7 can be fixed together as shown in FIGS. 4 and 5 by a nut 9 and bolt 15 for joint pivoting about the pivot 14. To this end the nut 9 as shown in FIGS. 2B and 2C is formed on one side with a cylindrical extension or collar 9*a* and on the other side with a flat-sided projection 9*b*. The collar 9*a* is normally engaged between an upper extension 21 of the lever 6 and a stop 16 on the housing 1, the biasing spring 8*b* pressing the lever extension 21 continuously against the collar 9*a*. The projection 9*b* fits in a slot 7*a* cut through the lever 7 and can slide therein to allow the angular position of the lever 7 to be adjusted The bolt 15 bears on the opposite face of the lever 7 to lock the nut 9 tightly in place on the lever 7. The spring 8*a* continuously urges the nut 9 back against the stop 16 and urges the upper lever 7 clockwise about the bolt 14 as seen in FIG.

Figure 3:
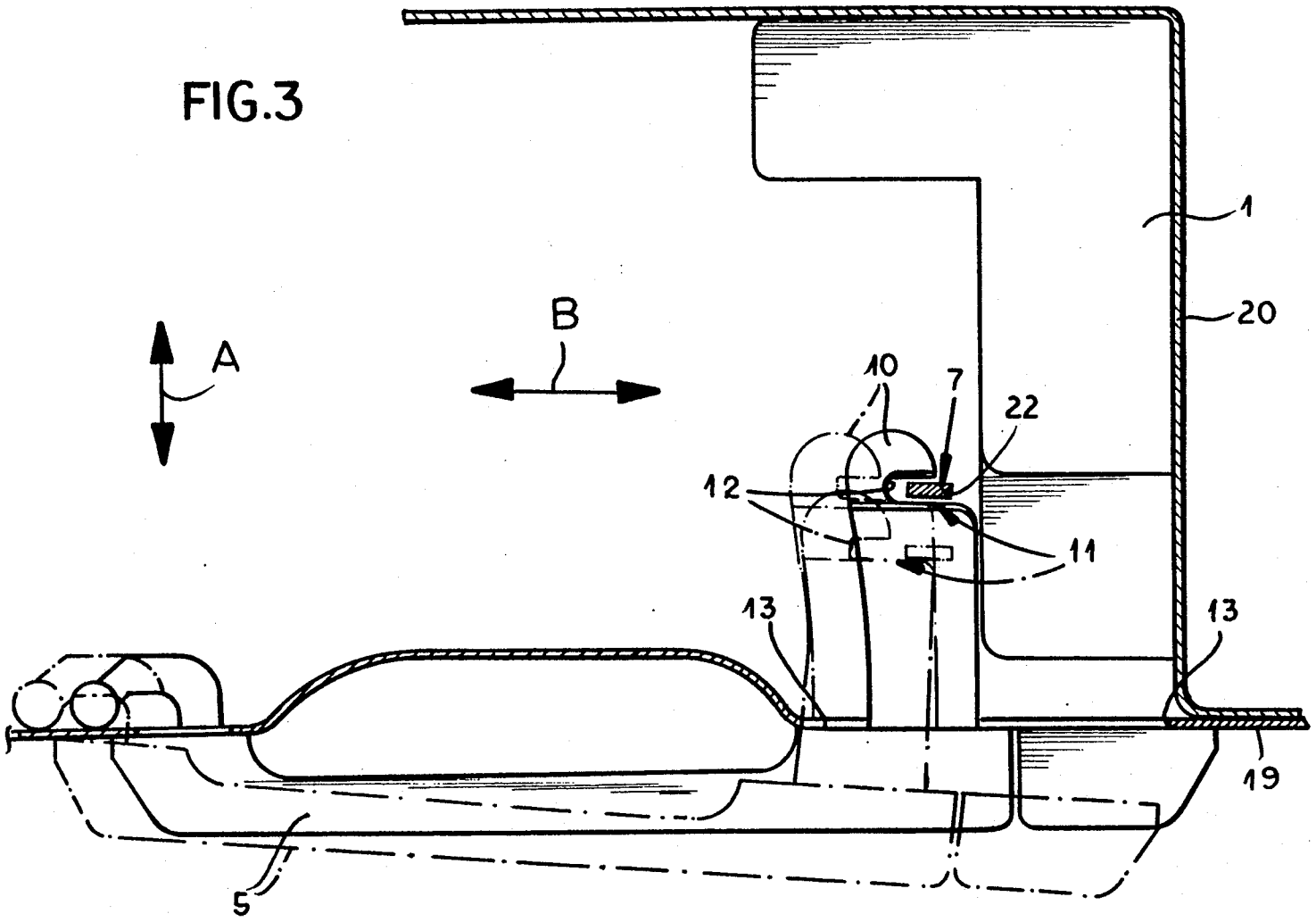
FIGS. 3, 4, and 5 are sections taken along respective lines 3S—3S, 4S—4S, and 5S—45S of FIG. 1.

As seen in FIG. 3 the outer door panel 19 is formed with a hole 13 through which projects an arm 10 of the outside door handle 5. This arm 10 is formed with shoulder 11 that can engage inward in the direction A against an upper end 22 of the lever 6 and is formed with a notch 12 into which this end 11 can fit snugly.

When the lock is originally installed the handle 5 is inserted as shown in dot-dash lines in FIG. 3 so that its shoulder 11 engages the lever upper end 22 and pushes it back into the solid-line position of FIGS. 1 and 3. Then the handle 5 is slid forward in the direction B to engage the end 22 in the holder notch 12, thereby solidly locking the two parts together.

In this position the bolt 15 is tightened to set the position of the nut 9 in the lever 6. Access to this bolt 15 can be had through a hole in the door edge 20, this hole of course being later plugged As a result the starting position of the lever linkage 4 is exactly set with respect to that of the handle 5, automatically compensating for different door thicknesses. Thus a small actuation stroke of the handle 5 is all that is needed to unlatch the door, a stroke that is all working stroke with no appreciable free travel.

I claim:

1. A motor-vehicle door latch for mounting in a door having an outside panel, the door latch comprising:

a housing fixed in the door;

a latching fork pivotal in the housing;

a latching pawl pivotal in the housing and engageable with the fork;

an outside door handle displaceable on the outside door panel between an outer actuating position and an inner rest position and formed with a pusher shoulder; and a linkage including an outside-handle lever pivoted on the housing, coupled to the outside door handle, and pivotal thereby in an outward direction on movement of the handle from the inner to the outer position, a latch lever pivoted at an axis on the housing and engageable with the pawl to operate same and release the fork, and releasable coupling means including a bolt for coupling the outside-handle lever and latch lever together on movement of the handle from the inner to the outer position for joint pivoting about the axis and for decoupling the levers for relative pivoting about the axis, whereby when decoupled the pusher shoulder of the outside-handle lever can move between an operating position and an installation position.

2. The motor-vehicle door latch defined in claim 1 wherein the releasable coupling means includes a nut threaded on the bolt.

3. The motor-vehicle door latch defined in claim 1 wherein the outside door handle and outside-handle lever have complementary interengageable formations that lock the outside handle to the outside lever when engaged together for joint movement.

4. A method of installing a motor-vehicle door latch in a door having an outside panel, the door latch comprising:

a housing fixed in the door;

a latching fork pivotal in the housing;

a latching pawl pivotal in the housing and engageable with the fork;

an outside door handle displaceable on the outside door panel between an outer actuating position and an inner rest position and formed with a pusher shoulder; and a linkage including an outside-handle lever pivoted on the housing, coupled to the outside door handle, and pivotal thereby in an outward direction on movement of the handle from the inner to the outer position, a latch lever pivoted at an axis on the housing and engageable with the pawl to operate same and release the fork, and releasable coupling means including a bolt for coupling the outside-handle lever and latch lever together on movement of the handle from the inner to the outer position for joint pivoting about the axis and for decoupling the levers for relative pivoting about the axis, whereby when decoupled the pusher shoulder of the outside-handle lever can move between an operating position and an installation position;

the method comprising the steps of:

mounting the outside door handle on the door and pushing with it the pusher shoulder of the outside-handle lever from the installation position into the operating position; and thereafter coupling the outside door lever to the latch lever by the coupling means for joint pivoting about the axis.

5. The motor-vehicle door latch defined in claim 1 wherein the bolt is offset from the axis and is fixable in one of the levers in any of a plurality of angularly offset positions and is angularly engageable with the other lever.

6. A motor-vehicle door latch for mounting in a door having an outside panel, the door latch comprising:

a housing fixed in the door;

a latching fork pivotal in the housing;

a latching pawl pivotal in the housing and engageable with the fork;

an outside door handle displaceable on the outside door panel between an outer installation position, an intermediate actuating position, and an inner rest position; and a linkage including an outside-handle lever pivoted on the housing, coupled to the outside door handle, and pivotal thereby in an outward direction on movement of the handle from the inner to the outer position, a latch lever pivoted at an axis on the housing and engageable with the pawl to operate same and release the fork, releasable coupling means including a bolt for coupling the outside-handle lever and latch lever together on outward movement of the handle from the inner position for joint pivoting about the axis and for decoupling the levers for relative pivoting about the axis, and spring means engaged with the handle lever for pivotally outwardly biasing the handle lever, whereby when decoupled the outside-handle lever can move from the outer installation position to the intermediate operating position by deflecting the handle lever only.

* * * * *